United States Patent [19]

Lane

[11] Patent Number: 5,012,711

[45] Date of Patent: May 7, 1991

[54] HIGH SPEED CUTTING AND STACKING APPARATUS

[75] Inventor: Donald A. Lane, Wakefield, Mass.

[73] Assignee: Dennison Manufacturing Company, Framingham, Mass.

[21] Appl. No.: 305,837

[22] Filed: Feb. 2, 1989

Related U.S. Application Data

[63] Continuation-in-part of Ser. No. 214,028, Jun. 27, 1988, Pat. No. 4,902,194.

[51] Int. Cl.[5] ..... B65H 29/24

[52] U.S. Cl. ..... 83/92; 83/152; 83/155; 414/798.5; 271/197; 271/149

[58] Field of Search ..... 83/90, 91, 92, 94, 100, 83/150, 298, 86, 88, 155, 152; 414/798.2, 798.5, 798.9, 788.9, 789.1; 271/181, 196, 197, 149, 221; 198/689.1

[56] References Cited

U.S. PATENT DOCUMENTS

| | | | |
|---|---|---|---|
| 2,421,874 | 6/1947 | Fouse | 414/798.5 X |
| 2,692,646 | 10/1954 | Eaton | 83/298 |
| 2,753,181 | 7/1956 | Anander | 271/2.3 |
| 2,881,836 | 4/1959 | Thiem et al. | 83/90 X |
| 2,952,457 | 9/1960 | Fliegner | 271/12 |
| 3,237,753 | 3/1966 | Allen et al. | 198/129 |
| 3,375,744 | 4/1968 | Schieven | 83/88 X |
| 3,468,531 | 9/1969 | Whittington | 271/62 |
| 3,739,667 | 6/1973 | Ernst | 83/92 |
| 3,743,403 | 7/1973 | Sanza | 355/3 |
| 3,774,783 | 11/1973 | Miller et al. | 271/87 X |
| 4,019,730 | 4/1977 | Staudinger et al. | 271/181 |

FOREIGN PATENT DOCUMENTS 2193951 2/1988 United Kingdom .

*Primary Examiner*—Douglas D. Watts
*Assistant Examiner*—Rinaldi Rada
*Attorney, Agent, or Firm*—Arthur B. Moore

[57] ABSTRACT

Apparatus for collecting tickets cut from ticket stock, and for stacking these tickets in a horizontal array. Tickets are collected and oriented to stacking position by a vacuum transport belt assembly and uniformly aligned by a horizontal stacker. The transport assembly is mounted on a housing which includes a vacuum drum to maintain ticket engagement with the transport belts, as the belts traverse a path having a horizontal to vertical orientation about the top and front of the housing. The stacker is mounted perpendicular to the front base of the housing and incorporates a stacking belt extending the length of, and parallel to the base of the housing. The stacking belt is incremented in the stacking direction, in synchronization with a cutter. Stacker infeed disks are mounted on the transport terminus roller in a unitary arrangement which both releases tickets from the transport and feeds tickets to the stacker, to improve processing efficiency. A friction-loaded back stop moveable along the stacking axis maintains successively fed tickets in an orderly array, in cooperation with the stacking belt. This arrangement enables continuous, high-speed stacking operation, and reduces apparatus sensitivity to variations in ticket size and composition.

24 Claims, 3 Drawing Sheets

FIG. 2
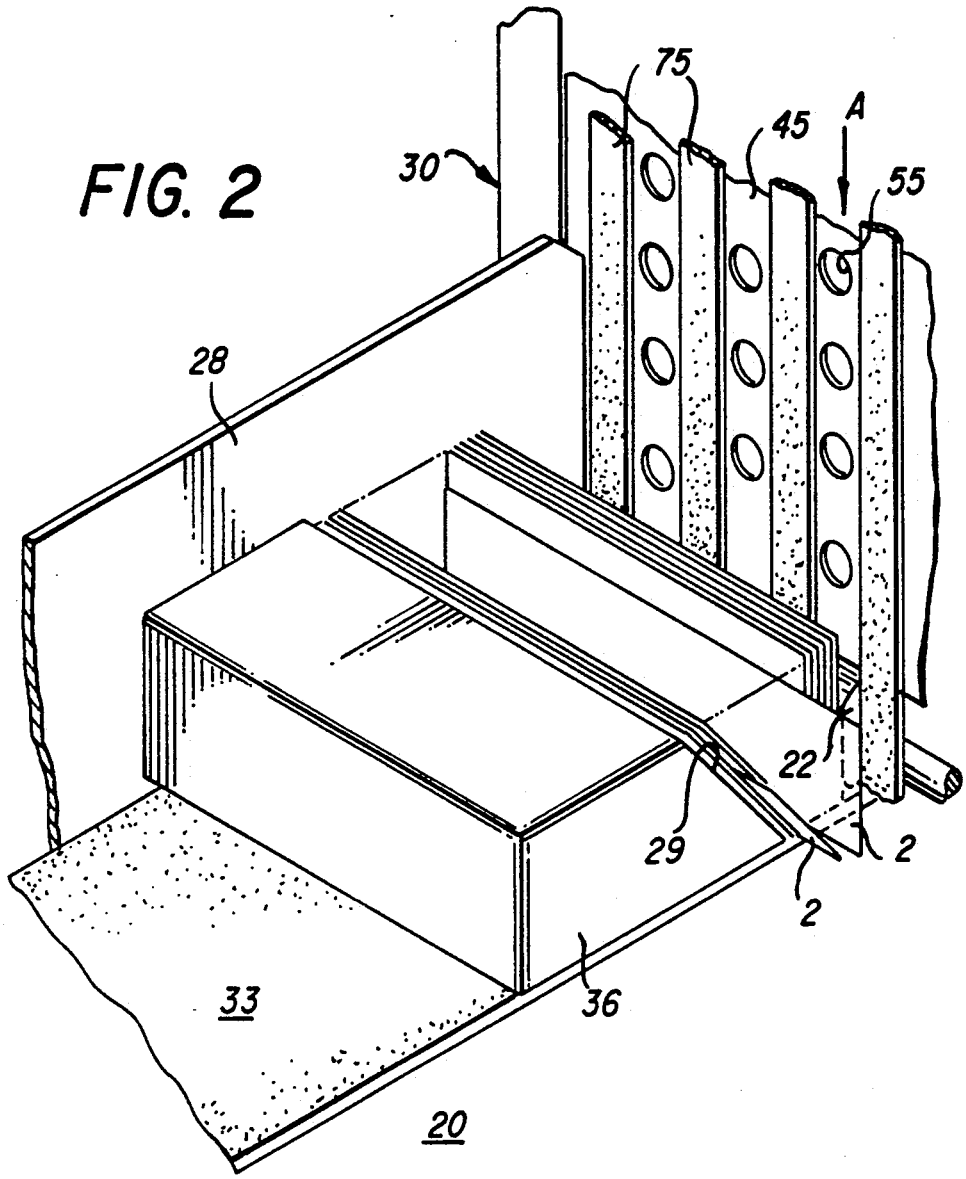
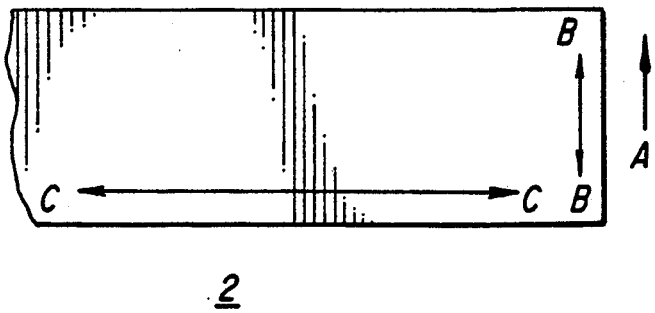
FIG. 3

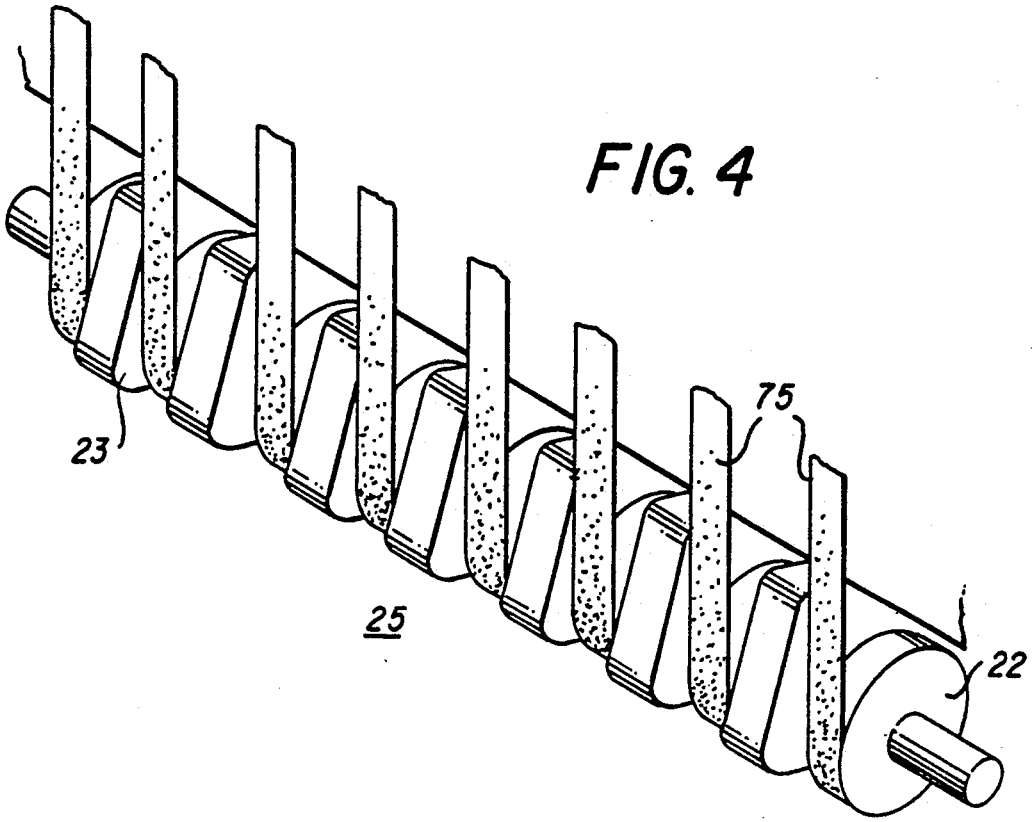
FIG. 4
FIG. 5
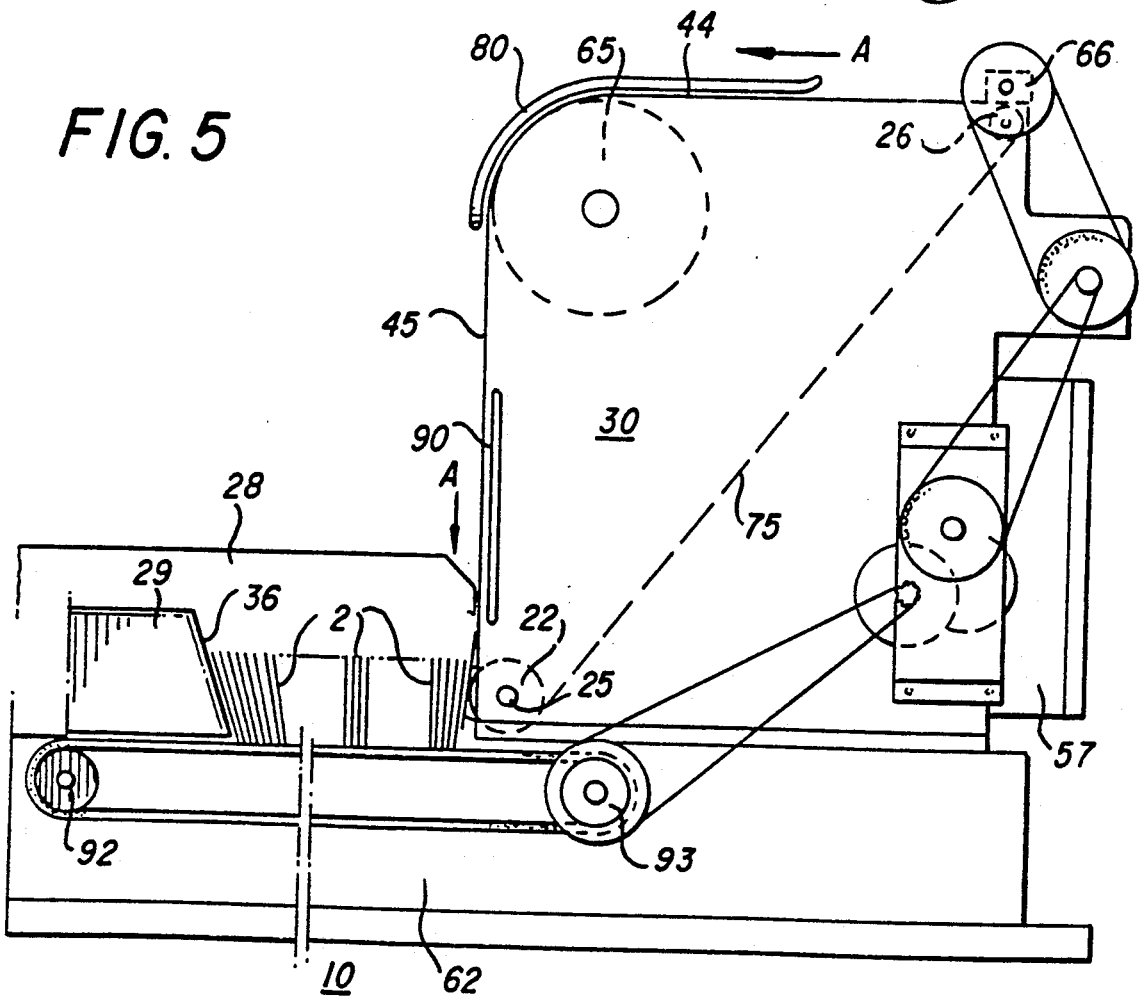

HIGH SPEED CUTTING AND STACKING APPARATUS

BACKGROUND OF THE INVENTION

This is a continuation-in-part of application Ser. No. 214,028 filed June 27, 1988 for collecting and stacking apparatus, now U.S. Pat. No. 4,902,194.

This invention relates generally to the art of collecting and stacking tickets or the like in a continuous, high-speed operation. More particularly, this invention relates to a system for collecting tickets of equal or variable length severed from ticket stock, and for stacking these tickets on edge, in a horizontal array.

At the present time, numerous devices have been provided to collect severed tickets in an orderly arrangement. These prior art devices are generally effective in performing collection and stacking operations, however they are characterized by sensitivity to ticket stock variations, such as stock weight, relative moisture content and rigidity. Furthermore, they generally require extended processing cycles for collecting and stacking each ticket. These constraints limit the severing rate of the ticket stock cutter. Consequently, it is desirable to remove collecting equipment sensitivities to stock variation, and to reduce the interval between successive ticket stacking cycles in order to allow the cutter to operate at maximum efficiency.

Accordingly, it is a primary object of the invention to increase the speed and efficiency of continuous operation of a ticket collecting and stacking system. A related object is to provide the capability of collecting and stacking a large number of tickets in continuous operation, independent of ticket length.

Another object of the invention is to provide apparatus which is not sensitive to variations in ticket stock.

A further related object is to provide efficient ticket stacking apparatus with a minimum of constituent parts, thereby lowering construction and maintenance costs.

SUMMARY OF THE INVENTION

In furthering the above and related objects, the ticket collection and stacking system of the invention collects and orients tickets for stacking, and uniformly aligns tickets into an array. The apparatus includes a vacuum transport belt; a ticket stacking belt; and means for directing tickets from the transport to the stacker. The apparatus is capable of handling variable length tickets.

In accordance with one aspect of the invention, apparatus for stacking tickets comprises a side plate; a stacking surface comprising a stacking belt parallel to the side plate; and infeed disk assembly for feeding tickets on edge to the input end of the stacking surface; a friction-loaded back stop moveable along the stacking axis in cooperation with the stacking belt, and means to increment the stacking belt wherein tickets are urged in the stacking direction and aligned along the side plate.

The stacking surface desireably comprises a thin, flat belt mounted on a housing. The infeed disk assembly desireably comprises a plurality of squared-corner disks mounted on a spindle attached at the input end of the stacking surface. In addition, the apparatus can further comprise a vacuum transport belt assembly which is mounted in front of the stacker, and in which the terminus of the transport is located at the input end of the stacker. Tickets can be collected from a cutter and fed to the stacker, and the terminus drive roller of the vacuum transport belt can include the infeed disks to couple the ticket collection means with the feeding means.

In an improved apparatus for processing tickets severed from a cutter to provide an array of tickets of the type including apparatus for collecting tickets and orienting tickets into stacking position, and apparatus for stacking tickets on edge in a horizontal array, the improvement can comprise an improved stacking system, including a side plate; a stacking surface which is incremented in the stacking direction in synchronization with a cutter, an infeed disk assembly for feeding successive tickets on edge to the input end of the stacking surface, and a friction-loaded back stop moveable along the stacking axis.

The stacking surface can include a flat, thin belt mounted on a housing located below the collecting apparatus and means for incrementing the belt in synchronization with the cutter. The infeed disk assembly can include a plurality of squared-corner disks mounted on a spindle attached at the input end of the stacking surface.

The vacuum transport belt assembly can comprise a housing with top and front surfaces having portions defining an opening at the intersection of the top and front surfaces and these surfaces having apertures forming an air pervious grid; a transport belt terminus drive roller mounted at the base of the housing front surface; a drum having apertures forming an air pervious grid about the circumferential surface of the drum, the drum rotatably mounted in a horizontal position with its longitudinal axis paralled with the front of the housing and the drum surface circumferentially tangental to the top and front surface edges proximate to the opening; means for continuously evacuating the housing to subatmospheric; and means for driving the drive roller. Advantageously, the drive roller has equally spaced annular grooves to accommodate a series of belt pulleys and infeed disks, and a transport belt idler roller is provided which is configured to accommodate the belt pulleys. Tickets may be conveyed along the top surface of the vacuum transport belt assembly to the apertured drum by a plurility of continuous belts. Preferable a 90 degree sector of the drum circumference is exposed to receive and convey tickets from the top surface to the front surface of the assembly.

In accordance with one aspect of the invention, tickets are received in a horizontal orientation by the transport belts after they have been severed by a cutter. The tickets are retained on the outer face of the transport belts by proximity of the spacing between belts to the air pervious grid. Tickets are moved along the top horizontal transport path of the housing by the belts and remain in contact with the belts as the belts and tickets pass over the vacuum drum to the vertical path along the front of the transport housing.

In accordance with another aspect of the invention, the transport belt drive pulleys and the infeed disks are commonly mounted on the transport belt terminus roller located at the input end of the stacker. Infeed disks are preferably positioned between each belt pulley and preferably project slightly above the belt surface. Tickets upon encountering the infeed disks are lifted from the transport belt vacuum and fed into the input end of the stacker. This arrangement links the transport drive with the feeding mechanism thus reducing stacker cycle time and avoiding complicated coupling arrangements.

In accordance with a further aspect of the invention, the tickets are collected on edge in a horizontal stacker which consists of a side plate, a stacking belt and a friction-mounted backstop. Tickets are fed into the stacker in a vertical orientation by the infeed disks. Successively fed tickets are stacked against the furthermost tickets by incrementation of the stacking belt in the stacking direction, in conjunction with each cycle of the cutter. Stacked tickets are maintained in an orderly array by operation of the backstop, which is incremented in the stacking direction by the stacking belt. The backstop is preferably angled to maintain the tickets in a forward-leaning orientation, to faciliate acceptance of successive tickets. This arrangement ensures orderly stacking under continuous, high-speed operation.

BRIEF DESCRIPTION OF THE DRAWINGS

The above and additional aspects of the invention are illustrated with reference to the detailed description which follows, taken in conjunction with the drawings in which:

FIG. 2 is a partial perspective view of the horizontal stacker;

FIG. 3 is a partial plan view of illustrative ticket stock;

FIG. 4 is a partial perspective view of the stacker and infeed disks; and

FIG. 5 is a side view of the apparatus in FIG. 1.

DETAILED DESCRIPTION

Figure 1:
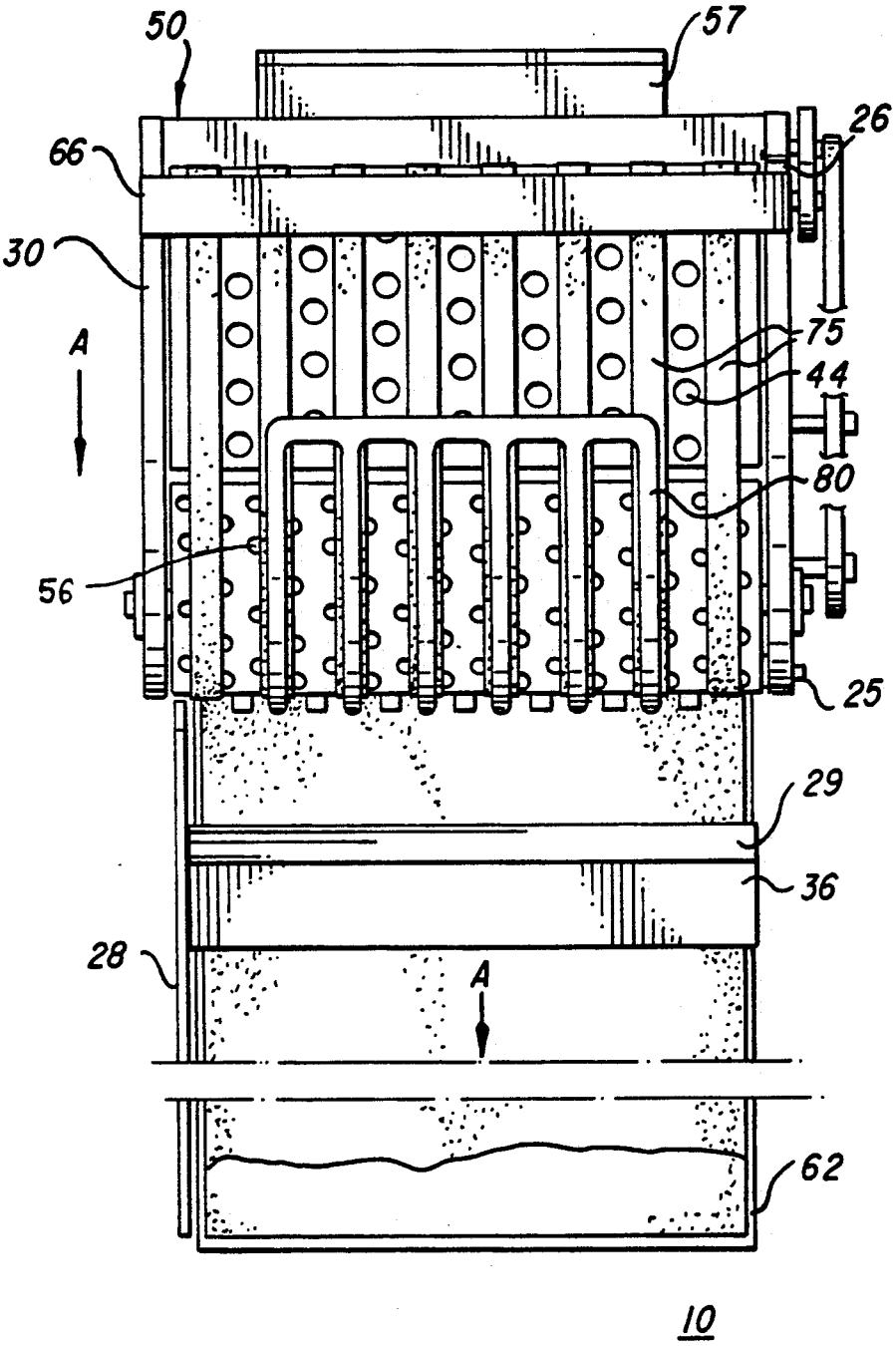
FIG. 1 is a plan view of collecting and stacking apparatus in accordance with the preferred embodiment.

Illustrative apparatus for collecting and stacking tickets cut from a strip of ticket stock in accordance with the invention is shown in the plan view of FIG. 1. The ticket processing apparatus 10 includes a vacuum transport belt assembly 50, housing assembly 30, and a horizontal stacker 20 for stacking tickets 2 fed by the infeed disks 22. Tickets 2 severed by a cutter are collected at the input end of the transport belt assembly 50. The vacuum transport belts 75 are driven in direction A by drive roller 25. Tickets 2 are retained on the belts 75 by suction along the aperture grid of the top 44 and front 45 housing 30 surfaces and the circumferential surface of the drum 65, as the transport belts 75 convey tickets 2 in direction A. (see also FIG. 5).

Tickets 2 collected in horizontal orientation along the top 44 pass over the drum 65 during transfer whereupon they assume vertical orientation as they are moved along the front 45 housing by the transport belts 75. Retention shield 80 ensures that tickets will be urged onto the transfer path and that they will not break free while traversing the horizontal to vertical transfer. Tickets 2 are released from the transport vacuum by infeed disks 22 as the tickets 2 reach the terminus of the transport, and are directed to the input end of the stacker 20. Successive tickets 2 directed to the stacker 20 horizontally accumulate as the stacking surface 33 is incremented in the stacking direction by the thickness of one ticket, in synchronization with the cutter 66.

Front aperture grid suction is adjustable by positioning of the slotted panel 90, which provides means for variably obstructing the grid from a plenum chamber, thereby adjusting the suction. Reduced suction is desirable for efficient ticket release when larger tickets are being processed.

FIG. 3 illustrates a severed ticket 2 to be collected by apparatus 10. Tickets 2 horizontally aligned along axis C—C are collected by apparatus 10 and moved in direction A. The apparatus 10 is compatible with a variety of ticket lengths, as measured along axis C—C, and ticket widths as measured along axis B—B. Additionally, apparatus 10 will accommodate a variety of tags, labels and the like.

The collecting and stacking system is readily described with reference to the plan view of FIG. 1. Upon being severed by cutter 66, tickets 2 in a horizontal orientation are collected at the input end of the vacuum transport belt assembly 50 on a plurality of continuous, adjacent transport belts 75; these belts 75 are suspended about the housing 30 by a rotatably mounted drive roller 25, a rotatably mounted idler roller 26 and a rotatably mounted drum 65. Adjacent belts 75 are advantageously spaced apart from each other a distance which is approximately equal to the belt width; belt spacing and support is effected by corresponding grooves 23 which seat the belts 75 in the idler roller 26 and drive roller 25. Referring to FIG. 1, seven belts are shown in the preferred illustrated embodiment; alternatively, the number of belts may be adjusted to adapt the apparatus to other applications.

The top 44 and front 45 housing 30 surfaces having apertures 55 defining an air pervious grid, intersect to define an opening; the drum 65, having apertures 56 about the circumferential surface forming an air pervious grid, is rotatably mounted in a horizontal position within the opening, such that the longitudinal axis of the drum 65 is parallel with the front 45 of the housing 30.

The positional relationship between the drum 65 surface and the top 44 and front 45 housing 30 surfaces is such that the drum 65 surface is circumferentially tangental to the top 44 and front 45 housing 30 surface edges proximate to the opening. Thus, the drum 65 circumference traverses the 90 degree arc between the top 44 and front 45 surfaces, so that there is a substantially continuous, air pervious surface area from the top 44 to the front 45 of the housing 30.

The endless transport belts 75 extend around the drive roller 25 and idler roller 26, and the drum 65, passing across the top 44 and front 45 surfaces of the housing 30. The housing 30 is continuously evacuated by a fan 57 during operation to reduce the pressure in the housing 30 to subatmospheric. The belts 75 are sufficiently spaced apart so that the vacuum along the contiguous air pervious surfaces firmly retains tickets 2 on the belts 75.

As shown in FIG. 2, the transport belt terminus drive roller 25 is rotatably mounted at the base of the front housing 30 surface, at the input end of the stacker 20. Infeed disks 22, as best seen in FIG. 4, fixed to the drive roller 25 in a spaced horizontal arrangement, are positioned between the belts 75. The infeed disks 22 have a width which is essentially equal to, and which in fact establishes, the space between the stacking belts. In the illustrated preferred embodiment, as depicted in FIGS. 2 and 4, the disks 22 have a non-round profile including corners, and a radius sufficient to extend the disks above the belt surface, for effecting the release of tickets 2 from the vacuum along the front housing 30 surface. This occurs when vertically oriented tickets 2, upon encountering the infeed disks 22 as tickets 2 move along on belts 75 in direction A, are directed away from the belt surface and thereupon break free of the vacuum. The infeed disks 22 further urge tickets 2 downward, at the input end of the stacker 20, and desireably, in the direction of the back stop 36 to enhance stacking.

When the apparatus is used to process larger tickets, reduced suction is desirable on the front aperture grid due to the increased surface area of the larger ticket; accordingly, for efficient ticket release, the slotted panel 90 is adjustable to partially restrict the lower portion of the front aperture grid from the plenum chamber.

In the preferred embodiment of the stacker 20 illustrated in FIG. 2, a side plate 28 is mounted on a horizontal supporting structure 62 of generally rectangular configuration. The side plate 28 is approximately the height of a single ticket 2, and is perpendicular in relation to the lower portion of the front housing 30. The stacking surface 33, which is approximately the width of a single ticket, is formed by a flat, thin endless belt which rotates about pulleys 92 and 93, mounted to the supporting structure 62, parallel with the bottom of the side plate 28. In the illustrated preferred embodiment of the invention, a planar support is mounted beneath the stacking surface belt to support the belt for collection of horizontally stacked tickets.

Incrementation of the stacking belt in the direction of displacement, for a distance equal to the thickness of one ticket, is synchronized with the operation of the cutter. A gear drive-pulley arrangement, coupled to a circular cutter, reduces a single 360 degree cycle of the cutter to the appropriate incrementation of the stacking belt drive pulley. Alternatively, other suitable means of electromechanical coupling of the cutter to the stacking belt may be employed to achieve the same result.

Tickets 2 are routed in a vertical orientation, on edge, into the horizontal stacker 20 by the infeed disks 22 and are aligned against the side plate 28. As shown in FIG. 2, a friction-loaded back stop 36 is mounted on a structure permitting horizontal movement along the stacking axis. The back stop face 29, is angled from vertical, slightly toward the stacking direction, in part to accommodate the projection of the infeed disks 22 at the input end of the stacker 20, and also to ensure that tickets do not become jammed at the input end of the stacker. Tickets 2, successively directed to the stacker 20 by the infeed disks 22, are driven toward the furthermost tickets 2 against the back stop 36, facilitating orderly stacking. This arrangement obviates the need for a more involved biasing assembly, and provides efficient, continuous stacking.

While various aspects of the invention have been set forth by the drawings and the specification, it is to be understood that the foregoing detailed description is for illustration only and that various changes in parts, as well as the substitution of equivalent constituents for those shown and described may be made without departing from the spirit and scope of the invention as set forth in the appended claims.

I claim:

1. An improved apparatus for collection and stacking tickets to provide an array of tickets of the type having a transport assembly for collecting tickets from a cutter and transporting the tickets to a stacker, and a stacking assembly for receiving the tickets and stacking the tickets in a horizontal array, wherein the improvement comprises an improved stacking assembly, comprising:

a planar stacking surface moveable along a horizontal stacking axis in a displacement direction away from an input end of said planar stacking surface, wherein tickets are stacked on said stacking surface in an upended configuration with an elongate edge of each ticket resting on the stacking surface;

a back stop, located above the planar stacking surface and having an upright stacking face which is inclined away from the input end of said stacking surface;

means for sequentially feeding tickets in a substantially vertical orientation to the input end of the stacking surface and for depositing tickets in a stack resting against the stacking face of said back stop; and means for incrementally moving the stacking surface and back stop along the horizontal stacking axis in said displacement direction.

2. Apparatus as defined in claim 1, wherein the stacking surface comprises:

a thin, flat endless belt rotatably suspended on two or more pulleys; and a planar support mounted beneath the stacking surface belt to support the belt for collection of a stack of tickets.

3. Apparatus as defined in claim 2, wherein the collecting and conveying means comprises a vacuum transport belt system.

4. Apparatus as defined in claim 1, wherein the feeding means comprises:

a housing having a plurality of apertures forming an air pervious grid along top and front surfaces of the housing, and the top and front surfaces defining an opening at the intersection of the top and front surfaces;

a drum having a plurality of apertures forming an air pervious grid, rotatably mounted in a horizontal orientation with its longitudinal axis parallel with the front of the housing and the drum surface circumferentially tangential to the top and the front surface edges proximate to the opening;

means for evacuating the housing to subatmospheric;

a plurality of equally-spaced continuous belts extending around rollers, wherein the belts are suspended about the top surface, the drum and the front surface; and means for releasing tickets from the belts at said front housing surface, and urging the tickets into said input end.

5. Apparatus as defined in claim 4, wherein the means for releasing tickets from the transport belts, comprises:

a plurality of disks mounted at the terminus of the transport belt system, located between the transport belts, which extend above the surface of the belts.

6. Apparatus as defined in claim 5, wherein the vacuum transport belt system further includes a slotted panel comprising:

a substantially flat panel slideably mounted against the inside front aperture housing surface, said slotted panel having openings defining slots which, when the panel is moved from a first position to at least one other position, partially obstructs the aperture grid from the plenum chamber, said slotted panel regulating the extent of suction on the front aperture grid to control the release of ticket stock into the stacker.

7. Apparatus as defined in claim 4, wherein the means for releasing tickets from the belts comprises a plurality of disks located between the belts and extending beyond the surface of the belts.

8. Apparatus as defined in claim 7, wherein the vacuum transport belt system further includes a retention shield comprising:

a plurality of substantially parallel members mounted slightly above transport belt surfaces and extending substantially about the top, drum and front of the housing beginning at the input end of the transport belt, said members guiding tickets onto the transfer path and preventing tickets from breaking free while traversing the horizontal to vertical transfer path.

9. Apparatus as defined in claim 1, wherein the ticket feeding means comprises:

means for conveying vertically oriented tickets in sequence; and a plurality of angularly profiled disks mounted on a rotatable roller for removing each ticket from said conveying means and urging the ticket into the input end of the stacking surface.

10. Apparatus as defined in claim 1, further comprising a ticket stock cutter; and means for conveying tickets from the ticket stock cutter to the feeding means.

11. Apparatus as defined in claim 10 wherein the incremental movement of the planar stacking surface and backstop is coordinated with the operation of the ticket stock cutter.

12. Apparatus as defined in claim 1 wherein the planar stacking surface and backstop are incrementally moved by approximately the thickness of a ticket.

13. Apparatus as defined in claim 1, further comprising a side plate extending along said horizontal stacking axis above said planar stacking surface, to limit ticket movement transverse to the stacking axis.

14. Apparatus for stacking tickets into a horizontal array, said tickets having length and width edges, comprising:

a planar stacking surface moveable along a horizontal stacking axis in a displacement direction away from an input end of said planar stacking surface, wherein tickets are stacked upended with a length edge resting against the planar stacking surface;

a back stop, moveable along the horizontal stacking axis above the planar stacking surface, said back stop having an upright stacking face which is inclined away from the input end of said stacking surface;

means for sequentially feeding tickets in a substantially vertical orientation to the input end of the stacking surface and for depositing tickets in a stack resting against the stacking face of said back stop; and means for incrementally moving the planar stacking surface and back stop along the horizontal stacking axis in said displacement direction away from the input end.

15. Apparatus as defined in claim 14, wherein the stacking surface comprises an endless belt.

16. Apparatus as defined in claim 15 wherein the endless belt is thin, further comprising means for supporting the belt to define the planar stacking surface.

17. Apparatus as defined in claim 14, further comprising a ticket stock cutter, and means for conveying tickets from said ticket stock cutter to said feeding means.

18. Apparatus as defined in claim 8, wherein the incremental moving means operates in coordination with said ticket stock cutter.

19. Apparatus as defined in claim 18, wherein the stacking surface comprises an endless belt, further comprising a gear train and a plurality of belts and pulleys drivingly connecting the cutter with a drive pulley for said endless belt.

20. Apparatus as defined in claim 14, wherein the conveying means comprises a vacuum transport belt assembly, including moving transport belts for guiding tickets and vacuum means for holding tickets against the transport belts via suction.

21. Apparatus as defined in claim 20, wherein the feeding means comprises means to release tickets from the transport belt assembly, comprising:

a plurality of disks mounted at the terminus of the transport belt assembly located between the transport belts, which extend above the surface of the belts;

wherein tickets are released from the transport belts by the disks which extend beyond the surface of the belts.

22. Apparatus as defined in claim 21, wherein the means for sequentially feeding tickets comprises a plurality of angularly profiled disks mounted on a rotatable roller; and means for sequentially conveying tickets in a vertical orientation to said plurality of angularly profiled disks, wherein said disks direct tickets into the input end of the stacking surface.

23. Apparatus as defined in claim 21, wherein the incremental moving means advances the planar stacking surface approximately by the thickness of a ticket.

24. Apparatus as defined in claim 21, further comprising a side plate extending along said horizontal stacking axis above the planar stacking surface, to limit ticket movement transverse to the horizontal stacking axis.

* * * * *